US008328397B2

(12) United States Patent
Long

(10) Patent No.: US 8,328,397 B2
(45) Date of Patent: Dec. 11, 2012

(54) EXTERIOR LIGHTING SYSTEM

(76) Inventor: Charles R. Long, McDonald, TN (US)

( * ) Notice: Subject to any disclaimer, the term of this patent is extended or adjusted under 35 U.S.C. 154(b) by 182 days.

(21) Appl. No.: 12/617,396

(22) Filed: Nov. 12, 2009

(65) Prior Publication Data

US 2010/0118556 A1 May 13, 2010

Related U.S. Application Data

(60) Provisional application No. 61/113,685, filed on Nov. 12, 2008.

(51) Int. Cl.
*F21V 21/36* (2006.01)
*F21S 8/00* (2006.01)

(52) U.S. Cl. ..... 362/403; 362/152; 362/431

(58) Field of Classification Search ..... 362/145, 362/147, 152, 403, 457, 431
See application file for complete search history.

(56) References Cited

U.S. PATENT DOCUMENTS

| | | | | |
|---|---|---|---|---|
| 3,670,159 | A * | 6/1972 | Millerbernd | 200/2 |
| 4,001,573 | A * | 1/1977 | Derasp | 362/403 |
| 4,851,980 | A * | 7/1989 | McWilliams et al. | 362/403 |
| 6,074,075 | A * | 6/2000 | Staniec | 362/249.11 |
| 6,447,150 | B1 * | 9/2002 | Jen et al. | 362/403 |
| 7,004,043 | B2 * | 2/2006 | Erel et al. | 74/89.23 |
| 7,393,124 | B1 * | 7/2008 | Williams | 362/431 |
| 2006/0042879 | A1 * | 3/2006 | Tepecik et al. | 187/250 |

* cited by examiner

*Primary Examiner* — Peggy A. Neils
(74) *Attorney, Agent, or Firm* — Stephen J. Stark

(57) ABSTRACT

A lighting system provides a lighting fixture elevationally adjustable from an energized configuration to a bulb-replacement configuration wherein the bulbs can be replaced, such as without using a ladder. The lighting fixture is retained by a slide to a slot. When a user releases the slide, it can be directed toward the user until the user can access the light fixture, replace one or more bulbs, and then return the fixture to its predetermined elevation for normal use.

20 Claims, 2 Drawing Sheets

EXTERIOR LIGHTING SYSTEM

CLAIM OF PRIORITY

This application claims the benefit of U.S. Provisional Patent Application No. 61/113,685 filed Nov. 12, 2008.

FIELD OF THE INVENTION

This application relates to an exterior lighting system, and more particularly to an exterior lighting system having an ability to lower a fixture to change light bulbs thereon and then return the fixture to an elevated position.

BACKGROUND OF THE INVENTION

There are many electrical fixtures available on the marketplace today. Some fixtures are configured for outdoor use and are believed to be often permanently mounted at corners of buildings below the roof to provide spot or floodlights around the building. In order to change these lights, an individual typically climbs a ladder and unscrews spent light bulbs and then screws new light bulbs in their place. While many services provide lifts or ladders which can reach these locations, many individuals don't have easy access to expensive lifts and other individuals may view ladders as risky activity which is best left to others, thereby potentially resulting in additional expense or risk to change light bulbs.

Accordingly, there is believed to be a need for improved outdoor exterior fixtures elevated out of the reach of individuals which provide alternate methods of bulb replacement other than relying on lifts and tall ladders.

SUMMARY OF THE INVENTION

It is an object of the present invention to provide an improved exterior lighting system whereby exterior fixtures may be lowered for changing bulbs and then returned to an operational configuration, and in many situations, without the operator leaving the ground.

It is another object of the present invention to provide improved exterior lighting alternatives.

It is another object of the present invention to provide for a simple and effective series of components which work together to lower and raise light fixtures relative to a building, such as at the outside of buildings.

In accordance with a presently preferred embodiment of the present invention, one or more exterior trim pieces is provided which provides a slot which receives a slide preferably constructed in sections therein. The slide connects at a top portion to a bracket which connects to an electrical fixture while also may preferably providing a plug which preferably cooperates with an outlet whereby when the fixture is in an uppermost position, the plug connects with the outlet thereby providing electricity to the fixture.

Upon moving of the slide downward, the plug disengages from the outlet thereby removing electricity to the fixture and thereby providing a safe and effective means for then being able to lower the fixture to a convenient location for the operator to facilitate bulb replacement in an unenergized light fixture. The slides may be preferably provided in sections so that one section may be removed from another after lowering a predetermined distance. Then, after providing a new light bulb on the fixture, the slide sections can be pushed upwardly and connected together as needed. The plug can then be reattached to the outlet thereby restoring the electrical connections necessary to power the light bulbs when so desired.

By disengaging the plug from the outlet during bulb replacement, safety is provided. Safety measures can include an ability to lock the slide in an up position as well as a safety catch which can catch slide portions in the event of the slides start sliding downwardly unexpectedly. Furthermore, an outlet at an upper portion of the structure is preferred and may be connected to an existing box such as with a cover and underlying wire channel coupled thereto and/or through a slot provided in the trim piece or pieces which therefore provides an ability to run wire from below the outlet if necessary and/or desirable.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
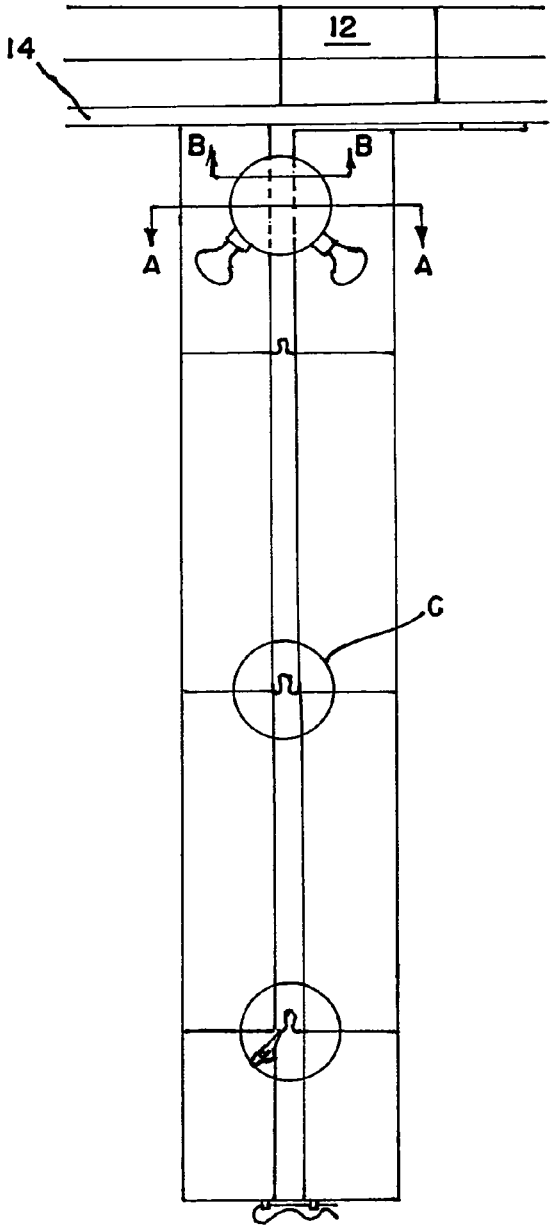
FIG. 1 is a front plan view of the presently preferred embodiment of the present invention.

FIG. 1 shows a presently preferred embodiment of the present invention, specifically a corner of a building 10 as illustrated as can be interpreted from shingles 12 on a roof. Roof could terminate at gutters 14 and/or fascia overhanging a soffit. First and second sidewalls 16,18 meet at corner 20. Although corner 20 is illustrated, this could also be a part of a wall such as a flat wall or still any other configurations in other embodiments. For example, see FIG. 8 and discussion below for one such embodiment. It is envisioned that the corner 20 could be an exterior right angled corner. This can be seen with reference to FIG. 2 but could also be at an internal right angle corner or could be some other angle corner whether inner or outer or flat as discussed above and below. The building 10 could be a new construction, a renovation, and/or add on to an existing structure.

Figure 2:
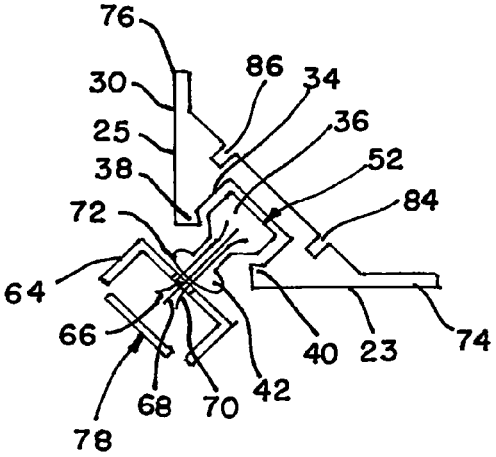
FIG. 2 is a cross-sectional view taken along the line A-A in FIG. 1.

In accordance with a presently preferred embodiment of the present invention, a plurality of sections 22,24, etc., are preferably connected together along the side of the building 10 or other structure. A top section 26 is connected to the top and a bottom section 28 is connected to the bottom. Intermediate sections 22,24 may be somewhat similar or dissimilar to each other as well as similar or dissimilar to the top section 26 and bottom section 28. In the preferred embodiment, the intermediate sections 22,24 are identical to one another and are provided in specific lengths such as four foot lengths. The sections may be plastic injected vinyl, plastic or other material that can be provided with a cross section such as cross section 30 as shown in FIG. 2 which will be discussed in detail below. Sections 20,22,24 and/or 28 could also be integrally provided as a single or multiple pieces.

Top section 26 can have a somewhat similar cross section at least along a portion of its length or its height as sections 22,24 as can bottom section 28. Furthermore, the sections 22,24,26,28 could each be constructed of more than one part such as right and left sides spaced by slot 34, etc.

As can be seen in reference to FIGS. 1 and 2, the sections allow for the ability for slide segment 32 to move linearly up and down relative to slot 34 such as with retainer 36 being located in slot 34. Ears 38 and 40 may assist in defining the slot 34 which may assist in keeping the retainer 36 inside the slot 34. Facer 42 may be useful in providing a somewhat uniform exposed surface at the front of the respective sections 22,24 by providing an appearance of being relatively continuous across the section 22 as well as the slide 32 with facer being continuous with surfaces 23,25.

FIG. 1 shows the lighting system 44 in an operational configuration. Specifically, lighting fixtures 46 with one or more bulbs 48,50 are plugged electrically into an electrical source as will be described below. Over time, when initially installed the bulbs 48,50 need to be replaced, or other time, instead of putting a ladder on the side of building 10 and climbing up a tall ladder or obtaining a lift mechanism which would be particularly expensive, the applicant has determined that it would be preferable to lower the fixture 46 to a location where the bulbs 48,50 and/or others can be replaced by an individual on a significantly lower ladder or none at all, rather than being up at the level of the fixture 46 when installed.

Figure 3:
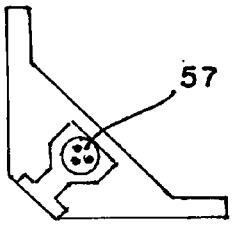
FIG. 3 is a cross-sectional view taken along the line B-B in FIG. 1.
Figure 4:
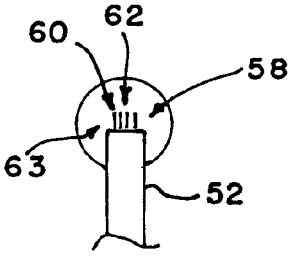
FIG. 4 is a rear plan view as taken behind an upper portion of the light fixture shown in FIG. 1.
Figure 6:
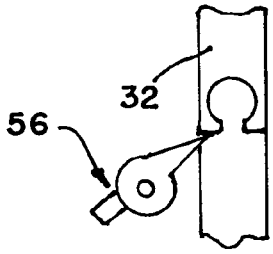
FIG. 6 is a front plan view of the internal workings of the detail D as shown in FIG. 1.

Accordingly, in the preferred embodiment, slide members 32 connect together to the top slide 52 such as is illustrated. Locking tab or pin 54, if utilized, can be removed which may otherwise at least assist in preventing the slide members 32 and 52 from being downwardly extended. Locking tab 56, if employed, can also be positioned to ensure that it does not grab a slide member 32 as is shown in FIG. 6 in a safety configuration. With these preparations performed, if necessary, the bottom-most slide member 32 or other slide member can then be directed downwardly thereby disengaging the uppermost slide member 52 from the outlet 57 as is shown in FIG. 3.

Specifically, in an installed configuration, pins 58,60, 62 of plug 63 engage respective connections in outlet positions of outlet 57 as would be known by those of ordinary skill in the art. Specifically, the pins 58,60,62 provide a plug 63 which is a male plug which is preferably received within a female outlet 57 which provides the electrical power when in the installed position of FIG. 1. Other electrical connections could be provided in other embodiments.

By disengaging the slide members by directing the top slide 52 away from the outlet 57, the box 64 which has the fixture 46 connected thereto can begin downward momentum to be accessible by an individual to change the light bulbs. In the preferred embodiment, electrical connection is broken and plug 63 disengages outlet 52. Electrical communications are shown in FIG. 2, specifically wires 66,68,70 extending through the box 64 and into the slide member 52 and they then will connect to respective pins 58,60,62 as would be understood by those of ordinary skill in the art while the other end of the wires 66,68,70 are connected to the appropriate wire connections of fixtures 46. The box 64 may be preferably positionably rotatably mounted relative to the facing 42. Specifically, base 72 may be received in the slide of facing 42 to allow it to move such as to be parallel with first panel 74 parallel to second panel 76 upwardly or downwardly as would be understood by those of skill in the art such as by having a locking ball post type arrangement received in a socket in the slide section 52 although other mechanisms as are well known in the art could be employed as well to connect box 64 to facing 42. The fixture 46 may be provided with or as a part of the box 64, or box 64 could be provided with exposed wire ends 66,68,70 for connection such as with wire nuts or otherwise to fixture 46 which could be provided by the user or by other parties such as the electrician. Other provisions could also be made to connect the fixture 46 to a power source. Cross bar 78 is useful to assist in mounting the fixture 46 thereto.

Fixture 46 is shown with two lamps with two light bulbs 48,50 extending therefrom, but it would be understood by those of ordinary skill in the art that one bulb 48,50, more and/or other bulbs or lamps may be provided by any particular fixture 46 or fixtures 46 as are well known in the art. The box 64 may also be integrally formed with the top slide member 52 through a variety of fabricating, forming and/or molding techniques or otherwise connected thereto.

Figure 8:
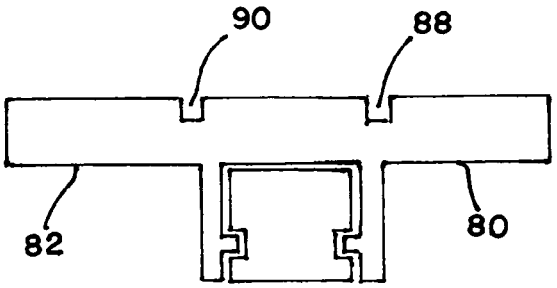
FIG. 8 is a cross-sectional view of an alternatively preferred embodiment from a similar perspective as provided in FIG. 2.

Panel 74 and 76 are illustrated at a 90 degree angle relative to one another such as can be found at a corner 20. In other embodiments such as the embodiment of FIG. 8, the panels 80,82 may be collinear such as against a planar wall. Other angle relationships could also exist. First and second slots 84,86 shown in FIG. 2 as well as first and second slots 88,90 shown in FIG. 8 are useful such as could be utilized to provide a conduit for Romex or other wiring to be directed to the outlet 56 shown in FIGS. 1 and 3. Slots 88,90 may, or may not, extend the height of the sections 22,24,26,28.

It is anticipated that first and second panels 74,76 may take on the appearance of trim and could be paintable in some embodiments. The facing 42 of the slide members 32,52 could match design features of the panels 74,76 or not. In one embodiment, the components could be of a vinyl siding type material and cooperate with vinyl siding to virtually disappear such as to be provided before or when the vinyl siding is put on possibly leaving a portion of the facing 42 exposed. In other embodiments, the panel 74,76 will be under, over or beside other siding options on the building 10. The sections 22,24,26,28 may be vinyl, other plastic material and/or other materials as would be known in the art.

The panels 22,24,26,28 may connect together to one another in various manners as is known in the art. Slide members 32 may connect such as with puzzle extension 92 and puzzle receiver 94 such that puzzle extension 92 could be placed into puzzle receiver 94 such as from front to back. Feet 96,98 could prevent the puzzle extension 92 from being pulled downwardly therefrom the receiver 94 once installed.

Figure 5:
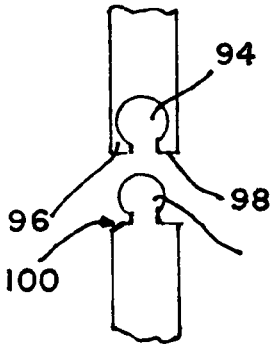
FIG. 5 is a front plan view of a connection system as shown in detail C as shown in FIG. 1.

Cut corner 100 is useful in some embodiments to cooperate with automatic locking pin 56 as is shown in FIG. 6 and FIG. 5 so that should slide member 52 become downwardly displaced inadvertently the locking pin 56 may grab on a bottom such as at foot 96 through corner 100 to prevent further unintentional downward movement. Other connection mechanisms or integral formation of slide members 32 as a slide could be provided.

Figure 7:
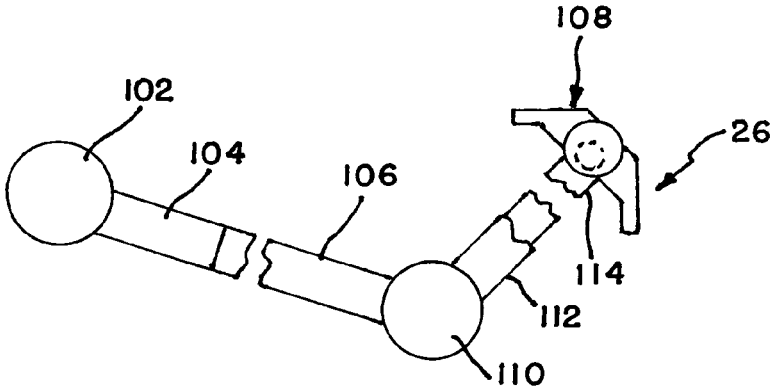
FIG. 7 is a bottom plan view of an outlet cover and ducting towards a top of the system as shown in FIG. 1.

Finally, FIG. 7 shows an outlet cover 102 connected to extension 104 which receives duct 106 which electrically connects a top 108 of the top section 26 to a nearby electrical box (obscured from view by cover 102) to provide a conduit for electrical wiring shown in phantom as would be understood by those of ordinary skill in the art to provide power to outlet 57. Duct 106 may connect to top section 26 in some embodiments. Rotatable housing 110 with extension 112 and duct 114 may be useful in other embodiments to assist in providing electricity to outlet 57. Ducts 106 and 114 are preferably extendably received in extensions 104,112 to provide adjustable lengths. Of course, in other embodiments, the fixture 46 could be wired without pins 58,60,62 and/or outlet 57. By having the extension 104 received over the duct 106, a variable length can be provided to account for a distance from an existing electrical box which would be opposite the outlet cover 102 and located proximate to the top 108 of the upper or top section 106. Rotatable housing 110 may be useful to assist in reaching the top 108 as would be understood by those of ordinary skill in the art. Other embodiments of top 108 may mount directly to an exposed electrical box or otherwise connected thereto as would be understood by those of ordinary skill in the art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An exterior lighting system comprising:

a lighting fixture having at least one replaceable bulb, said lighting fixture having an energized configuration wherein the lighting fixture is at least selectably in electrical communication with an electric source when positioned at a predetermined elevation;

a vertically extending slot operably coupled to a side of a structure, said lighting fixture operably coupled to the slot;

a de-energized configuration whereby electrical communication with the electric source is dis-engaged and disconnected remotely while said lighting fixture remains coupled to the slot; and a replacement configuration wherein the lighting fixture is displaced a first predetermined distance away from the predetermined elevation while in the de-energized configuration wherein an operator physically touches and replaces at least one of the one bulbs with the light fixture coupled to the slot; and an installed and energized configuration;

wherein movement at the lighting fixture between the replacement and installed and energized configuration utilizes a rigid slide in the slot which pushes the lighting fixture from the replacement configuration to the installed configuration and remains in the slot in the installed configuration, and the rigid slide is pushed from the first pre-determined distance towards the installed configuration.

2. The exterior lighting system of claim 1 wherein the slot is a linear slot and the de-energized configuration is directly related to displacement of the lighting fixture a second predetermined distance relative to the predetermined elevation along the slot.

3. The exterior lighting system of claim 1 further comprising two panels and wherein the slot is disposed intermediate the panels.

4. The exterior lighting system of claim 3 wherein the panels are oriented at 90 degrees relative to one another and the structure is a building.

5. The exterior lighting system of claim 3 wherein a cross-section the panels are collinear.

6. The exterior lighting system of claim 3 wherein the panels are disposed in cooperating sections whereby a plurality of sections provide the slot.

7. The exterior lighting system of claim 3 further comprising an opposite side slot on a side of the panels opposite from the slot and the predetermined elevation is proximate to a soffit of a building.

8. The exterior lighting system of claim 1 coupled to wherein said second predetermined distance is less than the first predetermined distance.

9. The exterior lighting system of claim 8 further comprising sectional slide members forming the slide.

10. The exterior lighting system of claim 9 wherein the slide members interconnect with puzzle connections in the slot.

11. The exterior lighting system of claim 8 further comprising a locking tab, said locking tab at least partially assisting in retaining the lighting fixture in the energized configuration by preventing downward movement of the slide.

12. The exterior lighting system of claim 8 further comprising a locking tab, said locking tab normally biased to engage the slide.

13. The exterior lighting system of claim 12 wherein the slide is comprised of slide segments and said slide segments have at least one foot for receiving the locking tab.

14. The exterior lighting system of claim 8 further comprising an ear assisting in defining the slot wherein the ear at least assists in retaining the slide in the slot.

15. The exterior lighting system of claim 1 further comprising one of an outlet and a plug disposed toward an end of the slot, said one of outlet and plug cooperating with an opposing one of an outlet and a plug connected to the light fixture thereby providing the energized configuration when connected at the predetermined elevation of the light fixture.

16. The exterior lighting system of claim 15 further comprising a box, said box connected to the lighting fixture, said box connected to the opposing one of the outlet and the plug.

17. The exterior lighting system of claim 1 wherein the slot has a retainer, said retainer extending from a side of the slot and assisting in defining the slot.

18. The exterior lighting system of claim 1 further comprising a top section, said top section connected by an extension receiving a duct to an outlet, said duct and extension cooperating for at least a limited length adjustment thereby facilitating the supply of an electrical source to the lighting fixture in the energized configuration.

19. An exterior lighting system comprising:

a lighting fixture having at least one replaceable bulb, said lighting fixture having an energized configuration wherein the lighting fixture is at least selectably in electrical communication with an electric source when positioned at a predetermined elevation;

a vertically extending slot operably coupled to an exterior surface of a structure, said lighting fixture operably coupled to the slot;

a replacement configuration wherein the lighting fixture is remotely displaced a first predetermined distance away from the predetermined elevation while coupled to the slot wherein an operator physically touches and replaces at least one of the at least one replaceable bulb and then returns the lighting fixture along the slot to the predetermined elevation to then be in the energized configuration; and a rigid slide slidable in the slot when transitioning between the energized and the replacement configurations, said slide preventing access into the slot in the installed configuration and pushing the lighting fixture from the replacement configuration to the installed configuration from the first predetermined distance.

20. The exterior lighting system of claim 19 further comprising a de-energized configuration whereby electrical communication with the electric source is dis-engaged and the de-energized configuration is directly related to displacement of the lighting fixture a second predetermined distance relative to the predetermined elevation along the slot; and the first predetermined distance is greater than the second predetermined distance.

* * * * *